US005240151A

United States Patent [19]

Worm

[11] Patent Number: 5,240,151

[45] Date of Patent: Aug. 31, 1993

[54] PUMP FOR TRANSMISSION AND DIFFERENTIAL OIL HAVING AN ADJUSTABLE COLLAR AND A RETURN FLOW LINE

[76] Inventor: Robert R. Worm, 4130 High Way 212, Chaska, Minn. 55318

[21] Appl. No.: 772,571

[22] Filed: Oct. 7, 1991

[51] Int. Cl.[5] ..... B67D 5/00

[52] U.S. Cl. ..... 222/318; 222/159; 222/385; 222/460; 141/126

[58] Field of Search ..... 222/383, 382, 385, 318, 222/159, 424, 464, 460; 141/46, 126

[56] References Cited

U.S. PATENT DOCUMENTS

| | | | |
|---|---|---|---|
| 329,067 | 10/1885 | Nelson | 222/385 |
| 503,232 | 8/1893 | Franklin | 222/385 X |
| 792,857 | 6/1905 | Strong | 141/126 X |
| 1,045,964 | 12/1912 | Friese | 222/318 |
| 1,730,684 | 10/1929 | Phillips | 222/385 X |
| 1,875,902 | 9/1932 | Wickwire, Jr. | 141/126 X |
| 2,507,888 | 5/1950 | Clapp | 222/385 X |
| 2,545,350 | 3/1951 | Fuld | 222/555 X |
| 2,550,157 | 4/1951 | Mazza | 222/385 X |
| 2,577,417 | 12/1951 | Halpin | 222/385 |
| 2,784,748 | 3/1957 | Eichenlaub | 141/126 X |
| 3,093,267 | 6/1963 | Lowery | 222/159 |
| 3,858,686 | 1/1975 | Luterick | 222/464 X |
| 4,162,745 | 7/1979 | Anderson, Jr. | 222/464 X |
| 4,343,326 | 8/1982 | Pelov et al. | 222/159 X |
| 4,583,668 | 4/1986 | Maynard, Jr. | 222/568 X |
| 5,022,561 | 6/1991 | La Gasse et al. | 222/568 X |

FOREIGN PATENT DOCUMENTS

| | | | |
|---|---|---|---|
| 202417 | 11/1955 | Australia | 222/385 |
| 22654 | of 1904 | United Kingdom | 141/126 |

*Primary Examiner*—Andres Kashnikow
*Assistant Examiner*—Anthoula Pomrening
*Attorney, Agent, or Firm*—S. Michael Bender

[57] ABSTRACT

A pump for use with containers with differential and transmission oil includes an adjustable collar for attachment to the containers, and a length adjustable casing to facilitate oil removal from the bottoms of the containers. The pump is manually operated and includes a flexible tube for delivery of the oil to a desired location. A bell-shaped adjustable collar facilitates an attachment of the pump to the top of the container, and an overflow line having a sight gauge can be used to determine when no more oil should be pumped to the receiving structure. Small baffles may also be provided interiorly of the pump casing to prevent solid residue and particles from being pumped into the differential or transmission of a vehicle. In a modified embodiment, the baffles comprise thin magnetized plates so as to be particularly effective in capturing ferromagnetic particles.

1 Claim, 4 Drawing Sheets

PUMP FOR TRANSMISSION AND DIFFERENTIAL OIL HAVING AN ADJUSTABLE COLLAR AND A RETURN FLOW LINE

BACKGROUND OF THE INVENTION

1. Field of the Invention

The present invention relates to manually operated pumps, and more particularly pertains to a manually operated pump which is particularly designed for attachment to containers of differential and transmission fluid.

2. Description of the Prior Art

Removable manually operable pumps for removing fluids from commercial containers is well known in the prior art. Typical examples of such pumps are to be found in U.S. Pat. No. 3,494,512 which is entitled "Self-metering Lubricating Oil Pump Attachment Device" and which issued on Feb. 10, 1970 to R. Haynes; U.S. Pat. No. 3,587,940 which is entitled "Conversion Kit Adapter For Dispensers and which issued to R. Ellis on Jun. 28, 1971; U.S. Pat. No. 3,844,452 which is entitled "Container With Removable Pump" and which issued on Oct. 29, 1974 to M. Blum; and U.S. Pat. No. 4,548,344 which is entitled "Adaptor Assembly For Jerry Cans and Storage Drums" and which issued on Oct. 22, 1985 to Hestehave et al.

Each of these above-mentioned pumps are functional for their intended purposes and each are specifically designed for certain types of containers. None are particularly well adapted for use with heavy fluids, such as heavy oil and the like, and further, they are not adapted to fit over a container of virtually any size. As such, there is a continuing need for specially adapted removable hand pumps which can be utilized with heavy-weight fluid such as transmission and differential oil and in this respect, the present invention substantially fulfills this need.

SUMMARY OF THE INVENTION

In view of the foregoing disadvantages inherent in the known types of removable manually operable pumps now present in the prior art, the present invention provides an improved removable manually operable pump which is specially designed to handle heavy fluids and which is adaptably attachable to a large number of different containers. As such, the general purpose of the present invention, which will be described subsequently in greater detail, is to provide a new and improved removable manually operable pump which has all the advantages of the prior art removable manually operable pumps and none of the disadvantages.

To attain this, the present invention essentially comprises a pump for use with containers with differential and transmission oil includes an adjustable collar for attachment to the containers, and a length adjustable casing to facilitate oil removal from the bottoms of the containers. The pump is manually operated and includes a flexible tube for delivery of the oil to a desired location. A bell-shaped adjustable collar facilitates an attachment of the pump to the top of the container, and an overflow line having a sight gauge can be used to determine when no more oil should be pumped to the receiving structure. Small baffles may also be provided interiorly of the pump casing to prevent solid residue and particles from being pumped into the differential or transmission of a vehicle. In a modified embodiment, the baffles comprise thin magnetized plates so as to be particularly effective in capturing ferromagnetic particles.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved removable manually operable pump which has all the advantages of the prior art removable manually operable pumps and none of the disadvantages.

It is another object of the present invention to provide a new and improved removable manually operable pump which may be easily and efficiently manufactured and marketed.

It is a further object of the present invention to provide a new and improved removable manually operable pump which is of a durable and reliable construction.

An even further object of the present invention is to provide a new and improved removable manually operable pump which is susceptible of a low cost of manufacture with regard to both materials and labor, and which accordingly is then susceptible of low prices of sale to the consuming public, thereby making such removable manually operable pumps economically available to the buying public.

Still yet another object of the present invention is to provide a new and improved removable manually operable pump which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
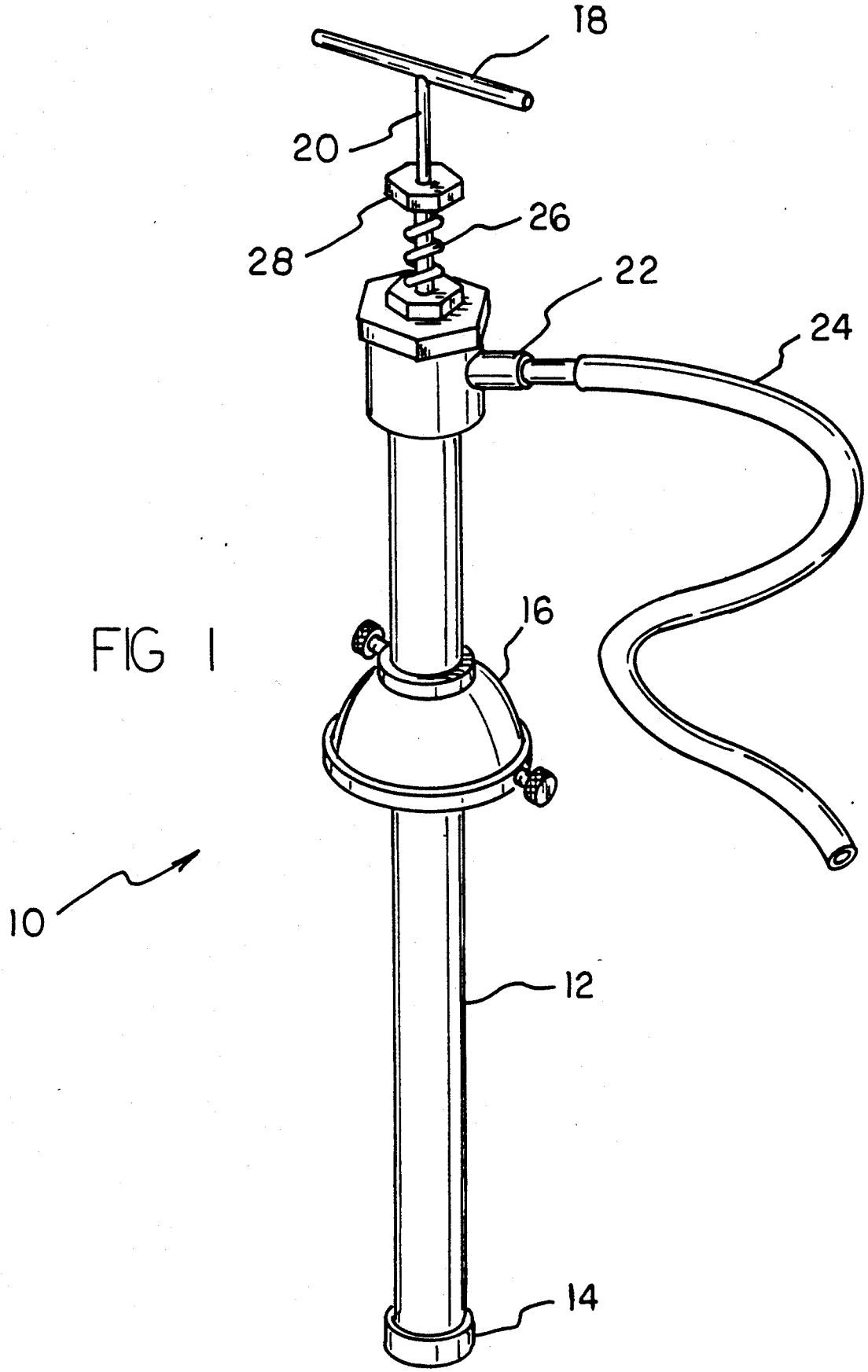
FIG. 1 is a perspective view of a first embodiment of manually operable pump embodying the principals and concepts of the present invention.
Figure 2:
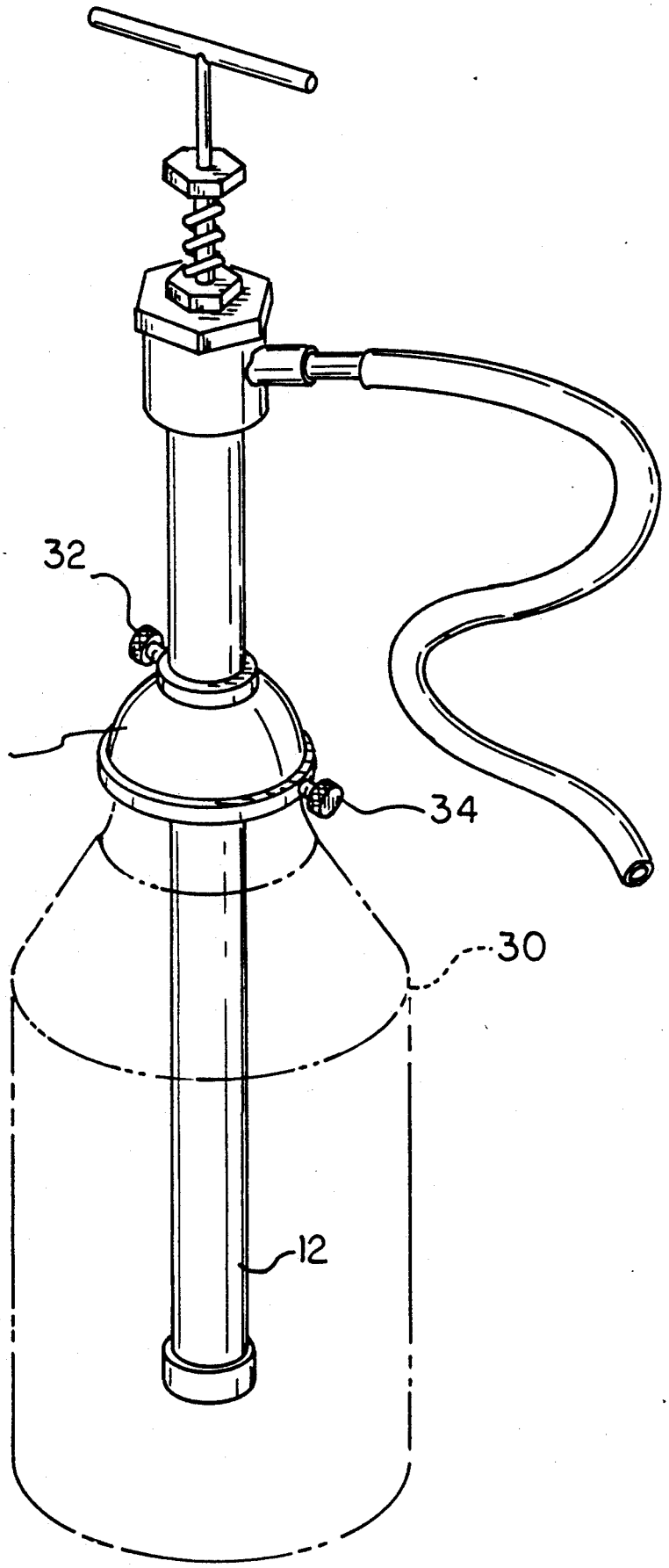
FIG. 2 is a perspective view of the pump showing it operably attached to a container.

With reference now to the drawings, and in particular to FIGS. 1 and 2 thereof, a new and improved removable hand pump embodying the principles and concepts of the present invention and generally designated by the reference numeral 10 will be described.

More specifically, it will be noted that the hand pump 10 comprises an elongated pump casing 12 having an inlet 14 located at a bottom section thereof, and a bell-shaped adjustable collar fitting 16 is positionable along the pump casing. The pump is operated by a handle 18 integrally attached to a pump shaft, and a discharge spigot 22 is formed in a top section of the pump casing 12. A flexible discharge hose 24 is attached to the spigot 22, and a compression spring 26 is fixedly secured to the pump shaft 20 by a connector 28 and operates to return the pump shaft into the pump casing 12 upon a release of manual force. The entire assembly 10 is designed to be positioned over a container 30 containing transmission or differential fluid. As shown, the pump casing 12 may be lowered into the container 30 until the proper depth is achieved, and the adjustable collar fitting 16 may then be locked against the pump casing 12 by means of screw 32, while screw 34 may also be tightened to attach the container 30 directly to the adjustable collar.

Figure 3:
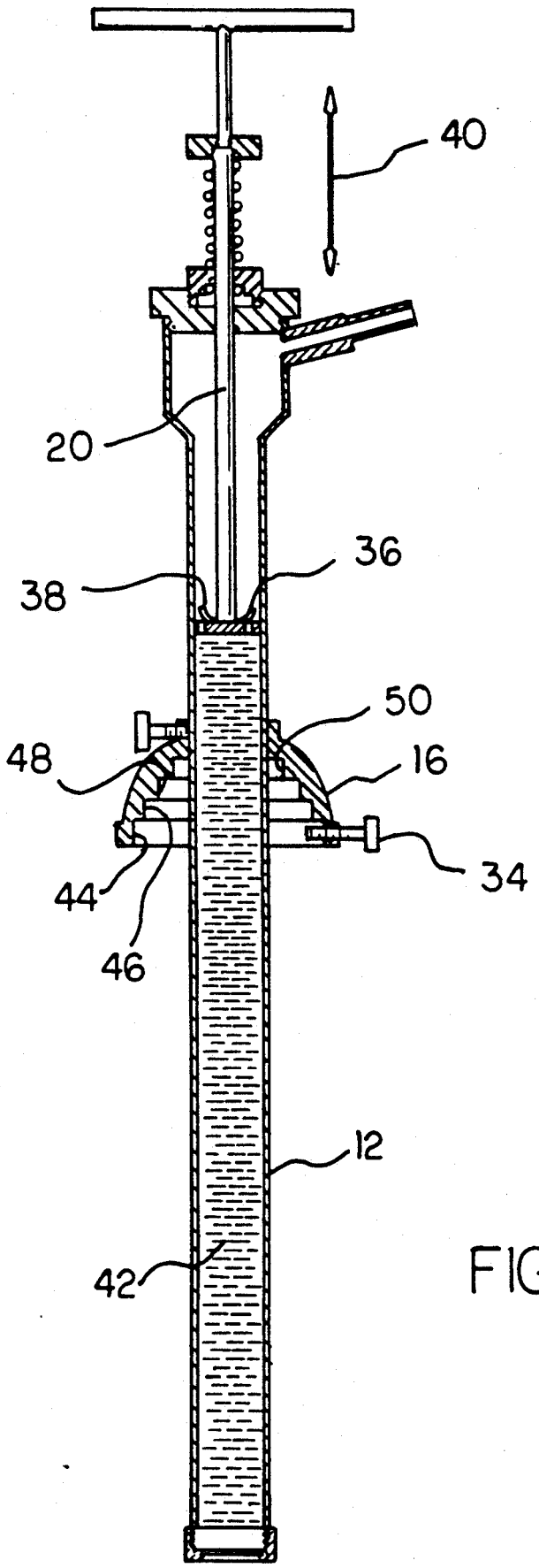
FIG. 3 is a cross-sectional view of the pump.

With reference to FIG. 3 of the drawings, it becomes evident that the pump shaft 20 is fixedly secured to a piston 36 having a plurality of one-way flat valves 38 mounted on a top portion thereof. Inasmuch as a limited stroke of travel 40 is available to the pump shaft 20, the interior bottom portion of the pump casing 12 is provided with a large number of small ribs or baffles 42 which are designed to interfere with particle and residue flow upwardly through the casing. In a modified embodiment, these small ribs could be constructed of a magnetic material so as to capture ferromagnetic residue and particles, and they would be embedded within the interior walls of the casing 12 so as to not interfere with the piston 36.

Another novel feature of the invention is illustrated in FIG. 3 wherein it can be seen that the bell-shaped adjustable collar fitting 16 utilizes a plurality of circular cutouts 44, 46, 48, 50 with each of these cutouts being of a decreasing diameter whereby the collar may be positioned over virtually any size of container spout. More specifically, a spout having a diameter slightly smaller than the cutout 44 but yet larger than the cutout 46 would obviously be retained within the cutout 44. However, a spout having a diameter less than the diameter of the cutout 50 would pass through all of the cutouts 44, 46, 48 so as to engage a bottom lip portion of the cutout 50 prior to the tightening screw 34 being brought into engagement with the associated container 30.

Figures 4, 5, 6, 7:
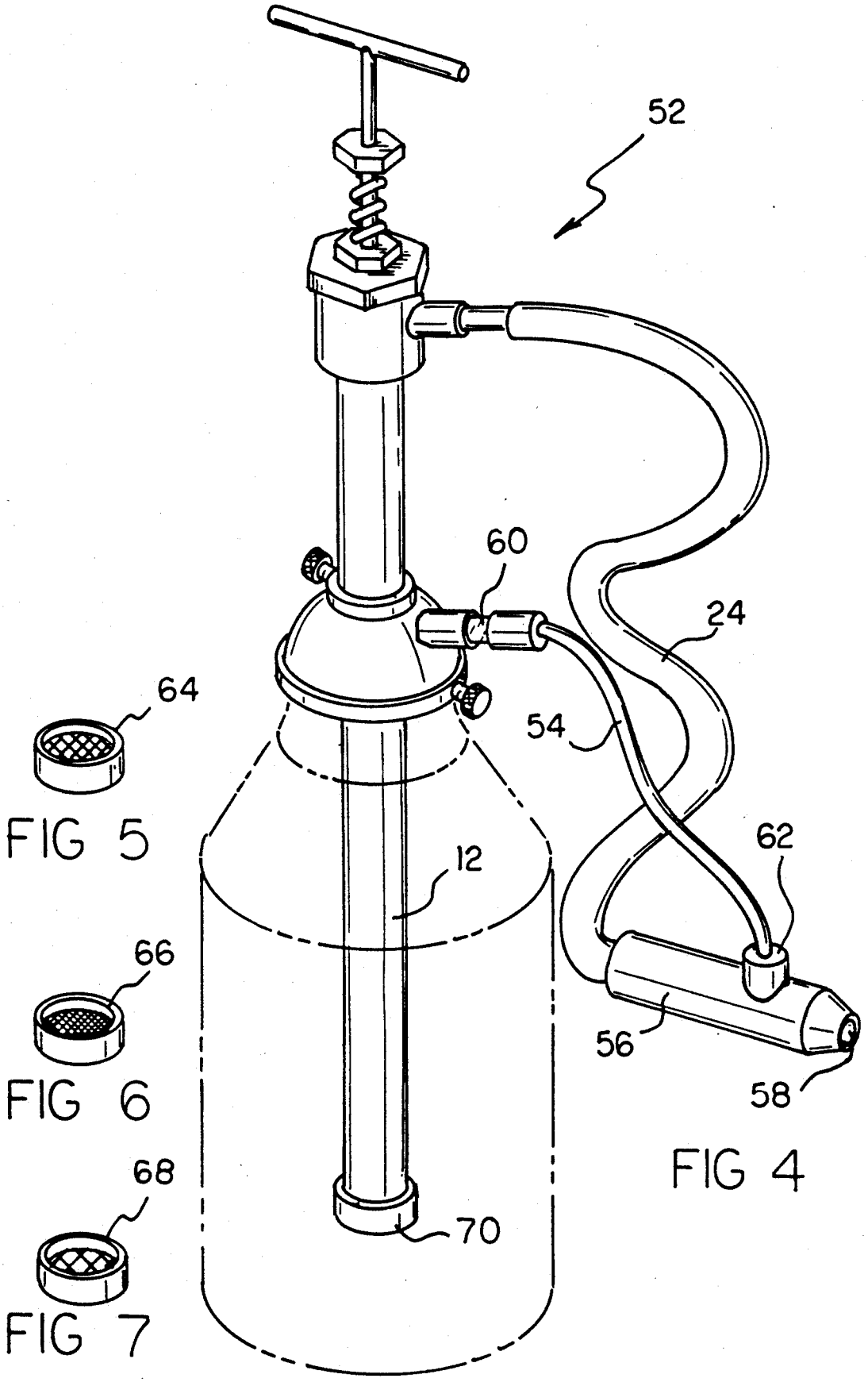
FIG. 4 is a perspective view of a modified embodiment of the invention.
FIG. 5 is a perspective view of a removable filter screen utilizable with both embodiments of the invention.
FIG. 6 is a modified embodiment of the screen.
FIG. 7 is a further modified embodiment of the screen.

FIG. 4 of the drawings illustrates a modified embodiment of the invention which is generally designated by the reference numeral 52. This modified embodiment of the invention is substantially identical to the embodiment 10 shown in FIGS. 1 and 2, with the exception that an overflow line 54 attached to a delivery nozzle 56 is included. In this embodiment 52, the flexible hose 24 is provided with the delivery nozzle 56 having an orifice opening 58, and this nozzle may be press fitted into a differential or transmission for the purpose of force feeding transmission or differential fluid thereto. When the transmission or differential becomes full of fluid, fluid passes back through the smaller line 54 past a transparent sight gauge 60, and is then delivered back into the pump casing 12 below the piston 36. A small pressure release valve 62 is formed in the nozzle structure 56 whereby this backward flow of fluid only occurs upon a detection of excessive pressure during a manual pumping operation.

FIGS. 5, 6 and 7 illustrate different types of filter screens 64, 66, 68 which may be frictionally fitted over the intake end 70 of the pump casing 12. These filters enhance the cleaning properties of the baffles 42 whereby a user can be substantially sure only clean and pure fluid is being delivered to his transmission or differential.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United Sates is as follows:

1. A new and improved manually operable pump assembly attachable to a fluid holding container, said pump assembly comprising:

pump means including a pump casing positionable interiorly of said container;

adjustable collar means to facilitate an attachment of said pump means to said container; and flexible delivery tube means for delivering said fluid to a desired location, said adjustable collar means being positionable along a longitudinal axis of said pump casing, whereby said pump casing may be extended to a bottom portion of said container by such positioning of said collar means; said adjustable collar means including a plurality of decreasing diameter openings designed to fit over a spout of said container, all of said openings being disposed on a continuous concave surface of said collar means whereby all of said openings are in communication with one another and are sized to fit a variety of different sized container spouts; and further including first locking means for positioning said adjustable collar means at a chosen position on said pump casing and second locking means for positioning said collar means in fixed communication with said spout of said container, and a delivery nozzle having an input side and an output size, said flexible delivery tube means being connected to the input side of said delivery nozzle, further including return flow means associated with said delivery tube means, said return flow means facilitating a return of pumped fluid when a receiving structure has been sufficiently filled with said fluid, said return flow means comprising flexible tubular return passage means having one end thereof connected to said delivery nozzle between the input side and the output size thereof, pressure relief valve means disposed on said return passage means in communication with said delivery nozzle to facilitate return flow of fluid through said return passage means in response to a predetermined back pressure sensed by said valve means, said flexible tubular return passage means having another opposed end thereof connected to and opening into said adjustable collar means, further including sight glass means for viewing a return of said fluid through said flexible tubular return passage means, wherein said second locking means comprises a screw means extending through a portion of said collar means common to one of said openings thereof disposed on said continuous concave surface.

* * * * *